United States Patent [19]

Knorreck et al.

[11] Patent Number: 4,593,962

[45] Date of Patent: Jun. 10, 1986

[54] ELECTRICAL PLUG AND SOCKET CONNECTION

[75] Inventors: Peter Knorreck, Weissach; Manfred Krämer, Schwieberdingen, both of Fed. Rep. of Germany

[73] Assignee: Robert Bosch GmbH, Stuttgart, Fed. Rep. of Germany

[21] Appl. No.: 561,599

[22] PCT Filed: Apr. 21, 1983

[86] PCT No.: PCT/DE83/00074

§ 371 Date: Dec. 5, 1983

§ 102(e) Date: Dec. 5, 1983

[87] PCT Pub. No.: WO83/04143

PCT Pub. Date: Nov. 24, 1983

[30] Foreign Application Priority Data

May 6, 1982 [DE] Fed. Rep. of Germany ..... 3216984

[51] Int. Cl.[4] ..... H01R 4/00

[52] U.S. Cl. ..... 339/94 M; 339/126 RS; 339/103 M

[58] Field of Search ..... 339/94 R, 94 M, 103 R, 339/103 M, 126 RS, 45 M

[56] References Cited

U.S. PATENT DOCUMENTS

| | | | |
|---|---|---|---|
| 2,655,638 | 10/1953 | Allen | 339/94 M |
| 2,984,811 | 5/1961 | Hennessey, Jr. et al. | 339/45 M |
| 3,017,597 | 1/1962 | Nava et al. | 339/94 M |
| 3,266,009 | 8/1966 | Jensen et al. | 339/103 M |
| 3,576,517 | 4/1971 | Johnson et al. | 339/94 R |
| 3,786,396 | 1/1974 | Kemmer et al. | 339/94 R |
| 3,818,420 | 6/1974 | Barr | 339/94 R |
| 4,193,655 | 3/1980 | Herrmann | 339/103 M |
| 4,310,213 | 1/1982 | Fetterolf et al. | 339/103 M |

*Primary Examiner*—Gil Weidenfeld
*Assistant Examiner*—David L. Pirlot
*Attorney, Agent, or Firm*—Frishauf, Holtz, Goodman & Woodward

[57] ABSTRACT

An electrical plug and socket connection which is suitable for Diesel engine unit governors containing oil under pressure and which given the hard operation prevailing in motor vehicles is embodied as tight with respect to pressure, lubricating oil and splashing water and as vibration-proof. The electrical plug and socket connection has a first plug part (3), which is directed in a pressure-tight manner out of a housing (1) of the governor and in which plugs (11) are disposed, likewise in a pressure-tight manner. A second plug part (16) having plug sockets (29) for receiving the insertion sections (12) of the plugs (11), which sockets (29) are disposed in a sealed manner with respect to splashing water and soiling, has means (22, 34, 39, 40) for the sealed and strain-relieved reception of a cable (33), the stranded conductors (32) of which are secured on the plug sockets (29). The second plug part (16) is held on the first plug part (3) so firmly, in the inserted state, by a covering connection nut (42) that no relative movement is possible between the plug parts (3, 16) and thus between the plugs (11, 12) and the plug sockets (29).

9 Claims, 4 Drawing Figures

ELECTRICAL PLUG AND SOCKET CONNECTION

The present invention relates to a pressure tight, strain-relieved plug-and-socket connection, and more particularly to a plug-and-socket connection in which a plug element can be attached to a diesel engine governor or controller apparatus, subject to pressurized oil at the inside, and a socket connected to the plug, in which the plug and socket connection will be tight with respect to pressurized oil from the inside of the governor and, additionally, tight with respect to external influences such as humidity, salt spray and the like, while, further, being resistant to shock and vibration resulting from the operation of the diesel engine.

Background

Numerous plug connectors are known, in which round plugs form a first plug part and are received in a socket forming a second plug part, the plug parts being held in contact with one another, in the inserted state, by a covering connection union nut. In plug and socket connections of this type, however, there is the disadvantage that they do not meet the requirements for use in highly loaded Diesel engine units. Neither the first plug part nor the prongs positioned in it are disposed with sufficient tightness with respect to pressure, lubricating oil and splashing water, nor are they with respect thereto led out sufficiently tightly from an oil-filled governor located on the Diesel engine unit. Furthermore, the plug parts in known plug and socket connections are fastened together merely elastically by the covering union nut, since the plug parts rest not directly on one another but rather on both sides of a seal. As a result, relative movements of the plug parts against one another occur, which especially under the rough conditions prevailing in motor vehicle operation cause premature wear of the plugs and the socket parts.

THE INVENTION

It is an object to provide a plug-and-socket connection which will meet the rigorous and rough operating requirements of attachment to a diesel engine, and particularly to a diesel engine which may be used in vehicular applications, that is, which is exposed to environmental conditions which tend to corrode or mechanically interfere with good electrical contacts.

Briefly, a union-type coupling is being used in which, however, inner elements are provided which form a tight seal between a connecting cable and terminal elements which receive plug or prong terminal elements attached to a support plate or wall. A projecting sleeve portion of insulating material is formed on one of the parts of the plug-and-socket connection, which, for simplicity, may be termed the plug part. Projecting prongs are sealed within the plug part which in turn is sealed by a pressure tight seal connection into the wall through which the connection is to extend, for example, be a compressed O-ring. The plug part, arranged for sealing connection with the socket part, includes a carrier sleeve which has an outer guide surface formed thereon. The carrier sleeve surrounds, at one end portion, the cable which extends from the plug part. The carrier sleeve retains therein two elements, one forming an inner receiving bushing in which chambers are formed to receive terminal elements to contact the prongs, which terminal elements are attached, for example by solder, to the individual cable elements of the connecting cable. The bushing is retained within the carrier sleeve by an inter-engaging projection-and-recess arrangement, for example by snapping projecting prongs extending from the receiving bushing into matching recesses internally of the carrier sleeve. An end plate, and located thereagainst a sealing disk, both formed with openings, are positioned so that they will bear against end surfaces formed on the bushing. They are pressed against the bushing, for sealing engagement around the respective cable elements by a clamping sleeve which is also located inside of the carrier sleeve, and to press the sealing disk, and the end plate against the contact receiving bushing. Additionally, the clamping sleeve is formed with strain relieving corrugations which clamp against and engage around the cable. Tight engagement is insured by an outer union nut which engages over the carrier sleeve and which is, for example, screw connected to the outside of the protecting sleeve portion of the plug part.

The electrical plug and socket connection according to the invention has the advantage over the prior art that the electrical plug and socket connection can be used in Diesel engine units in which a first plug part, provided with prongs, can be led in a pressure-tight manner out of a governor housing that is filled with oil under pressure, and in which sufficiently good sealing prevails both between the housing and the plug part and between the plug part and the prongs. A further advantage is that the second plug part containing the socket parts can be clamped firmly, in the inserted state, to the first plug part or to the housing by means of the covering connection nut, which by reason of its guide section substantially reduces the undesirable freely-fluctuating length of the plug and socket connection and thus prevents relative movements between the plugs and the socket parts when in the connected state.

It is particularly advantageous if the second part is formed as an assembly of interlocking parts. The arrangement is so made in which it is assured that the socket parts and the ends of conductors connected to them and directed into the second plug part in a strain-relieved manner are located such as to be vibration-tight and tight against splashing water. A further advantage is that the first part has means for dissipating any high heat that arises briefly, for instance when the ends of the conductors are soldered while the plugs are already seated in the plug part, thereby preventing the formation of fissures and thus preventing a loss of tightness in the first plug part.

Furthermore, in an embodiment which is not only particularly pressure-tight and vibration-proof but also cost-effective, it is advantageous for the connection between the plug element and the conductor ends to be made prior to making the entire plug which plug may be part of a larger element made of insulating material and surrounding this connection.

DRAWING

Exemplary embodiments of the invention are shown in the drawing. Shown are:

FIG. 1, an exemplary embodiment of an electrical plug and socket connection, in longitudinal section;

FIG. 2, a first modification of the plug and socket connection of FIG. 1, seen in part in longitudinal section;

FIG. 3, a second modification of the plug and socket connection, seen in an end view; and FIG. 4, a partial section taken along the line IV—IV of FIG. 3.

DESCRIPTION OF THE EXEMPLARY EMBODIMENTS

Figure 1:
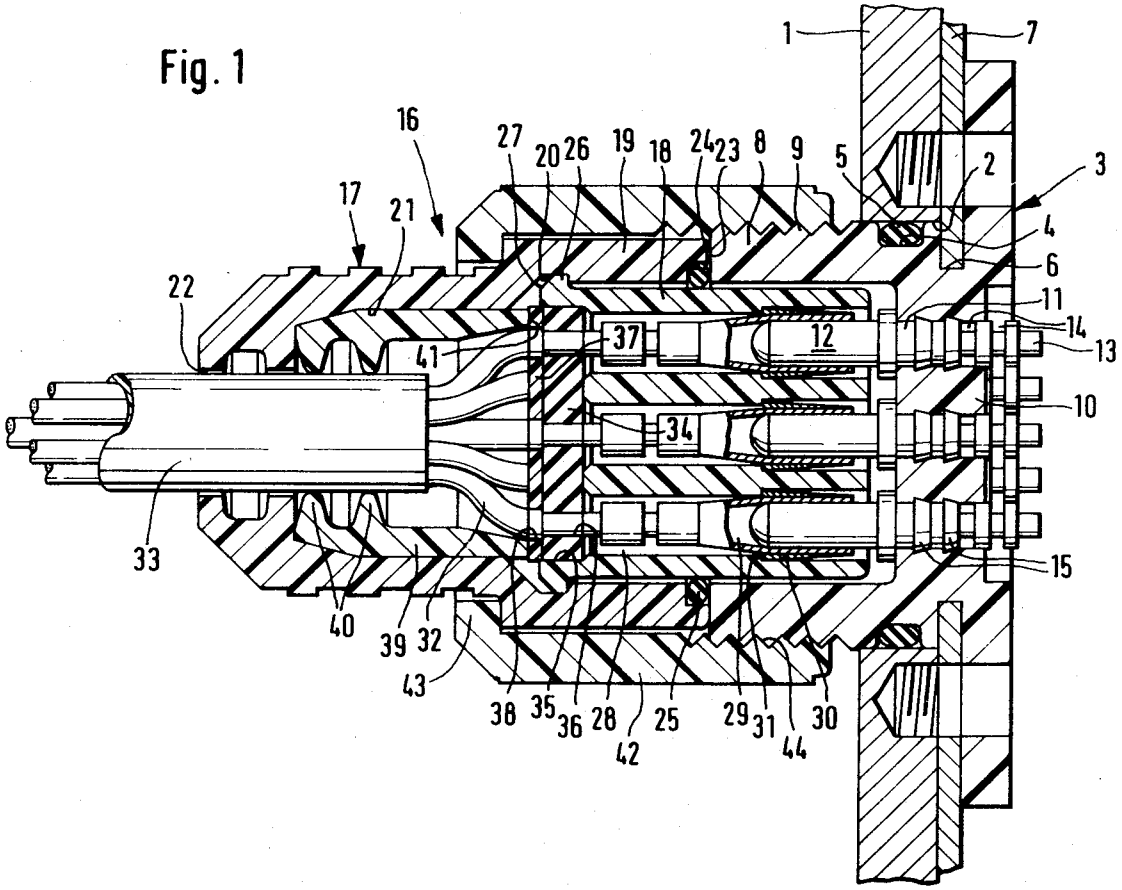

A housing 1 of a governor for a Diesel engine unit, which serves primarily to drive motor vehicles is formed with a bore 2. A first plug part 3 of insulating plastic, which is part of an electrical plug and socket connection, is inserted into the bore 2 in a pressure-proof manner. To this end, an annular groove 4 is formed on the circumference of the first plug part 3 and a sealing ring 5 placed therein. The first plug part 3 is inset into an opening 6 of a plate 7 disposed in the housing 1 and secured together with the first plug part 3 to the housing 1 in a manner known per se and not shown in detail, for instance with screws. The end of the first plug part 3 protruding out of the housing 1 is embodied as a sleeve-like receptacle section 8 and is provided with an outer thread 9. A plurality of plugs 11—for instance, seven—is inserted into the base 10 of the first plug part 3. Their rounded insertion section 12 protrudes into the receptacle section 8, while their end 13 extends into the housing 1. Electric conductors are soldered, clamped or welded to the ends 13 of the plugs 11 in a manner known per se and not shown in detail. To prevent the brief, severe heating that occurs during the hot-connecting of the electric conductors to the plug ends 13 from being conducted to the adjacent zone of the plug part 3, the plugs are provided on their ends 13 with heat traps, which are embodied as annular grooves 14. As a result, fissures which could arise in the plug part 3 and through which oil located in the housing 1 under pressure could escape are prevented from occurring despite the differing coefficients of expansion of the different materials making up the plugs 11 and the plug part 3, that is, electrically conductive metal and insulating plastic, respectively. The plugs 11 are secured in the base 10 of the plug part 3 against being pulled out by means of sawtooth-shaped protrusions 15.

A second plug part 16 comprises a carrier socket 17 and a contact bushing 18. The carrier socket 17 has an end section 19, which on the inside merges with an enlarged detent section 20. Merging with the detent section 20 is a receptacle section 21 of smaller diameter, which adjoins the other end of the carrier socket 17, which is embodied as a cable entrance 22. An annular groove 24 which is open toward the end face 23 is formed in the end section 19, and a sealing ring 25 is inlaid in this annular groove 24. The carrier socket 17 is made of insulating plastic, as is the contact receiving bushing 18. The cylindrical contact bushing 18 is provided, at one end of the jacket, with a detent collar 26 having an insertion bevel 27. Axially extending chambers 28 are embodied in the contact bushing 18, and in each of the chambers 28 one contact socket 29 for receiving an insertion section 12 of an associated plug 11 is inserted and is secured against being pulled out by means of tabs 30 behind protrusions 31 of the chambers 28. The contact sockets 29 are pushed onto stranded conductors 32 of a cable 33. The insulated cable 33 extends through the cable entrance 22 into the carrier socket 17. The chambers 28 of the contact bushing 18 are closed on the cable side by a seal 34. The seal 34 is embodied as a disc and inserted into a cylindrical recess 35 of the contact bushing 18. The individual stranded conductors 32 are directed through holes 36 in the seal 34 into the associated chambers 28. A cover disc 37 is disposed on the outside of the seal 34. The cover disc 37 also has holes 38 for the passage therethrough of the stranded conductors 32. In the receptacle section 21 of the carrier socket 17, a slotted clamping sleeve of socket 39 (not shown in detail here) of tough elastic material is inserted. It is provided with two inner edges 40, which surround the cable 33 protruding into the carrier socket 17 through the cable entrance 22. As a result, the cable 33 is held in the second plug part 16 in a strain-relieved manner. The clamping socket 39 rests with its annular face 41 on the cover disc 37 in a prestressed manner and is pressed radially inwardly by engagement with inner conical surfaces on the socket, or sleeve 17. As a result, the contact bushing 18 inserted into the end section 19 of the carrier socket 17, the detent collar 26 of which is snapped in place in the detent section 20 of the carrier socket 17, is firmly clamped within the carrier socket 17.

A covering connection nut 42 of plastic is placed on the cylindrical end section 19 of the carrier socket 17, this section 19 serving as a guide section. The nut 42 extends grippingly with an annular shoulder 43 over the end toward the cable of the end section 19 of the carrier socket 17. The end of the covering connection nut 42 protruding to the outside, past the end section 19, on the plug side is provided with an inner thread 44.

THE ASSEMBLED CONNECTION

In the inserted state of the electrical plug and socket connection, the insertion sections 12 of the plugs 11 are inserted into the plug sockets 29 at the ends of the stranded conductors 32 of the cable 33. The part of the contact bushing 18 protruding out of the carrier socket 17 is then seated in the receptacle section 8 of the first plug part 3. The carrier socket 17 then rests with its end face 23 on the end face of the receptacle section 8 of the first plug part 3. The covering connection nut 42 is threaded onto the outer thread 9 of the first plug part 3, and via the annular shoulder 43 holds the two plug parts 3 and 16 firmly against one another, so that relatively movements cannot occur between the two plug parts 3 and 16 and thus between the plugs 11, 12 and contact sockets 29 in the inserted state.

As a result of the sealing ring 5, the first plug part 3 is directed out of the housing 1, which is filled with oil under pressure, of a Diesel engine unit governor in such a manner that it is tight with respect to oil and splashing water. The prongs 11 protrude in a pressure-tight manner out of the housing 1 through the base 10 of the first plug part 3. The insertion area 8, 28 for the plugs 11, 12 and the plug sockets 29 is sealed from the outside against splashing water and soiling by means of the sealing ring 25 and the seal 34.

Figure 2:
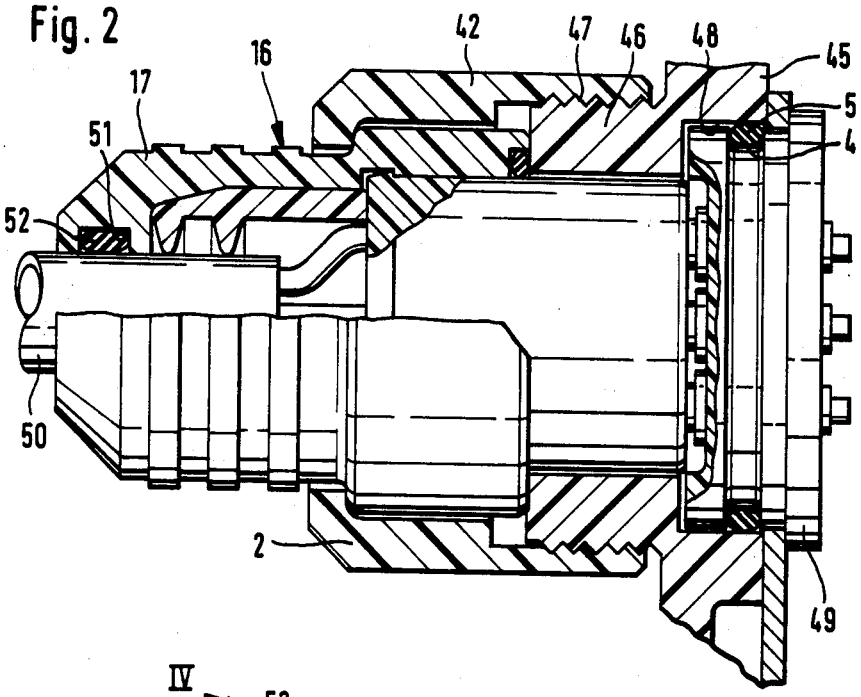

FIG. 2 shows a first modification of the electrical plug and socket connection. To the extent that elements are identical to those of the exemplary embodiment shown in FIG. 1, they are identified by the same reference numerals.

A socket-like receptacle protrusion 46 for the second plug part 16 is molded onto a modified housing 45 of the governor, this protrusion 46 replacing the receptacle section 8 of the first plug part 3 of FIG. 1. The receptacle protrusion 46 is provided on its jacket with a thread 47 for the threading on of the covering connection nut 42. On the inside of the housing, a cylindrical recess 48 is embodied concentrically with the receptacle protrusion, and a modified first plug part 49 is inserted into this recess 48. The first plug part 49 again has the annular groove 4, in which the sealing ring 5 is seated, and rests tightly against the cylindrical wall of the recess 48 of the housing. As a result, the first plug part 49 is disposed on the housing 45 in an oil-tight and pressure-tight manner.

If extruded cables 50 are secured on the second plug part 16, then to attain better sealing of the receptacle of these cables, the cable entrance 22 of the carrier socket 17 is additionally provided with an annular recess 51, in which a sealing ring 52 which tightly surrounds the extruded cable 50 in the vicinity of the cable entrance 22 is laid.

Figure 3:
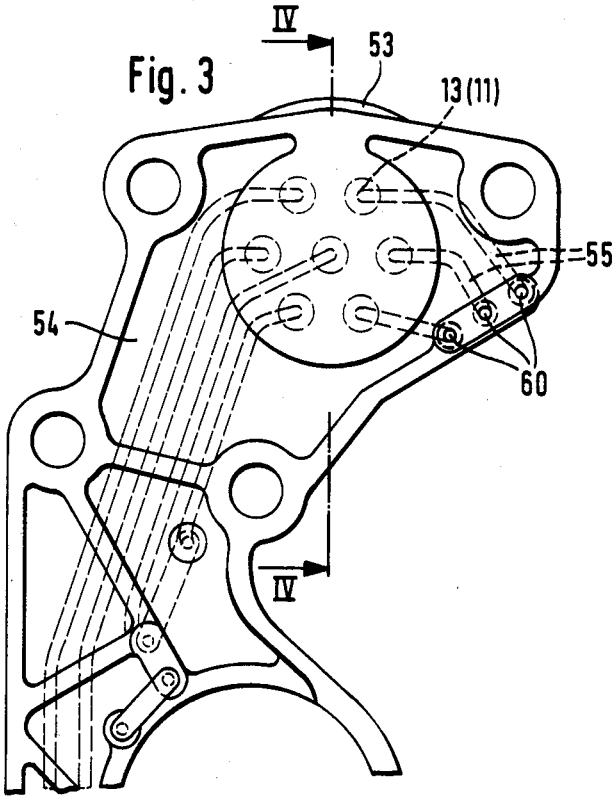
Figure 4:
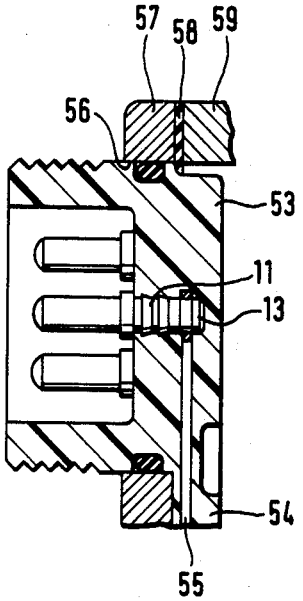

In FIGS. 3 and 4, a second modification of the electrical plug and socket connection is shown. To the extent that the elements are identical to those of the exemplary embodiment of FIG. 1, they have the same reference numerals.

A modified first plug part 53 is integrated directly into a connection plugboard 54 of a Diesel engine governor. To this end, the electrical conductors 55, in the form of wire conductors, are first secured to the ends 13 of the prongs 11, for instance by soldering, welding or clamping. Then the first plug part 53 and the plugboard 54 are united in one piece surrounding the prongs 11, 13 and the conductors 55, for instance by injection molding of an insulating plastic. The prongs 11 are thereby completely embedded in plastic in the connection area of their ends 13, together with the conductors 55 secured thereon, and are disposed in an absolutely pressure-tight manner in the first plug part 53. The first plug part 53 again has the annular groove 4, in which the sealing ring 5 is laid. The first plug part 53 corresponding in the remaining insertion area to the first plug part 3 of FIG. 1 protrudes through a bore 56 of a lid 57, which with the interposition of a seal 58 is secured on a housing 59 of the Diesel engine unit governor in a known manner known per se and not shown in detail. Also in a manner known per se, the conductors 55 are directed to connection points 60 for electrical devices, which again are not shown.

I claim:

1. Pressure-tight, strain relieved plug-and-socket connection, releasably and pressure and liquid tightly connecting an electrical cable (33, 50) to electrical conductors (55) located internally within a housing (1; 45; 57, 59) capable of retaining fluid under pressure, having a plug part (3, 49, 53);

a socket part (16) connectable with the plug part;

an electrical cable (33, 50) having cable elements (32) located therein secured in one of said parts, said other part being fitted in an opening (2) formed in the housing;

terminal prong elements (11) and terminal reception elements (29) secured in respective ones of the parts, and comprising a projecting sleeve portion (8) of insulating material formed on said other part extending through the opening (2), and sealingly retaining one of said terminal elements and forming therewith a unitary plug part, sealing means (4, 53, 56) sealing said unitary plug part in the opening in the wall of the housing;

and means for sealingly connecting the socket part and the plug part including a carrier sleeve (17) having an outer guide surface (19) formed thereon, one end of the carrier sleeve being formed with an opening for passage of the cable (33, 50) therethrough, and another end fitting against an end face of the projecting sleeve portion (8);

an inner contact receiving bushing (18) of insulating material formed with chambers (28) facing the plug part, the other terminal elements matching said one terminal element being received in the chambers of the receiving bushing, said carrier sleeve (17) being formed with an opening dimensioned to receive the contact receiving bushing 18;

inter-engaging projection-and-recess means (26, 20) being formed on the contact receiving bushing (18) and the carrier sleeve, respectively, to lock the contact receiving bushing within the carrier sleeve;

a sealing ring (25) surrounding the contact receiving bushing (18) and located between the other end face of the carrier sleeve (17) and the end face of the projecting sleeve portion (8);

an end plate (34) located against and supported on the end face of the contact receiving bushing (18) opposite the chambers, and formed with openings to permit passage of the cable elements (32) of the cable (33, 50) to respective ones of the other terminal elements (29);

a sealing disk (37) formed with sealing openings for the cable elements, located against said end plate and sealing the passage of the cable elements (32) with respect to the end plates;

a clamping sleeve (39) located within the carrier sleeve (17) and having an outer end portion bearing against the inside of the carrier sleeve and an inner end portion bearing against said sealing disk;

strain relieving corrugations (40) formed on said clamping sleeve and engaging the cable in the region of the passage of the cable out of the carrier sleeve and adjacent the opening at said one end for passage of the cable therethrough;

and a union nut (42) engaging the outer surface of the carrier sleeve (17) and the projecting sleeve portion (8) of the other part for coaxially clamping the carrier sleeve (17) against the projecting sleeve portion (8) of the other part and thereby clamping together the clamping sleeve (39), the sealing disk (37), the end plate (34), the sealing ring (25), and the contact-receiving bushing (18) into a liquid-tight unit, said union nut (42) having an inner surface extending over and being guided by a longitudinal portion of the outer guide surface (19) of the carrier sleeve (17).

2. A plug and socket connection as defined by claim 1, wherein the first plug part (3; 49; 53) includes a seal (5), fitted in the opening bore (2; 48; 56) of the housing (1; 45; 57; 59).

3. A plug and socket connection as defined by claim 1, wherein the carrier sleeve (17) is sealed on the end face with respect to the first plug part (3; 53).

4. A plug and socket connection as defined by claim 1, wherein the carrier sleeve (17) is sealed on the end face with respect to the housing (45, 46); and the first plug part (49) is received in the housing.

5. A plug and socket connection as defined by claim 1, wherein the first plug part (53) is formed as an insulating element extruded around one of the terminal elements (11) together with conductors (55) secured on them.

6. A plug and socket connection as defined by claim 1, wherein the first plug part (53) is formed in one piece with a board of insulating material (54) carrying the electrical conductors (55), and the ends of the conductors (55), prior to the assembly of the plug part (53) and board (54), are pre-assembled on the associated terminal elements to form a sub-assembly, which is then entirely surrounded with insulating material.

7. A plug and socket connection as defined by claim 1, wherein the terminal elements located in the projecting sleeve portion (8) include heat traps (14).

8. A plug and socket connection is defined by claim 1, wherein the inter-engaging projection-and-recess means include a detent (20, 26), formed in the interior wall of the carrier sleeve, and projecting means formed on the outside of the contact-receiving bushing (18) engageable in said detents.

9. A plug and socket connection is defined by claim 1, wherein the inside wall of the carrier sleeve (17) in the region of the opening at said one end for passage of the cable therethrough is inwardly tapering;

and said clamping sleeve (39) is slit and fits within the inwardly tapering wall to tightly grip the cable (33, 50) upon axial force being applied to the carrier sleeve upon tightening of the union nut (42) and to provide for inward compression of the clamping sleeve against the cable by engagement with said wall portion.

* * * * *